US005320925A

United States Patent [19]

Imai et al.

[11] Patent Number: 5,320,925

[45] Date of Patent: Jun. 14, 1994

[54] ELECTROPHOTOGRAPHIC TONER COMPOSITION

[75] Inventors: Takashi Imai; Satoshi Inoue; Masanori Ichimura; Yutaka Sugizaki; Susumu Saito; Masaru Miura; Michio Take; Yasuo Yamamoto; Koji Fukushima; Manabu Serizawa, all of Minami-Ashigara, Japan

[73] Assignee: Fuji Xerox Co., Ltd., Tokyo, Japan

[21] Appl. No.: 879,287

[22] Filed: May 7, 1992

[30] Foreign Application Priority Data

May 14, 1991 [JP] Japan ..... 3-137047

[51] Int. Cl.[5] ..... G03G 9/097

[52] U.S. Cl. ..... 430/110; 430/111

[58] Field of Search ..... 430/106.6, 109, 111, 430/137, 903

[56] References Cited

U.S. PATENT DOCUMENTS 5,137,796 8/1992 Takiguchi et al. ..... 430/109

5,147,744 9/1992 Sacripante et al. ..... 430/106.6

*Primary Examiner*—John Goodrow

*Attorney, Agent, or Firm*—Oliff & Berridge

[57] ABSTRACT

An electrophotographic toner composition comprising (A) toner particles with an average particle diameter of 9 μm or less comprising at least a binder resin and a colorant, and (B) an additive, wherein the additive is a fine metal oxide powder surface coated with at least one agent for imparting hydrophobic property selected from the group consisting of the following formulae (1), (2) and (3):

$R_1Si(X)_3$ $R_1R_2Si(X)_2$ $R_1R_2R_3Si(X)_1$ wherein $R_1$ represents a substituted or unsubstituted alkyl group having a molecular weight of 113 or more, $R_2$ and $R_3$ each represents hydrogen, an alkyl group or an allyl group, and X represents chlorine, an alkoxy group or an acetoxy group. The toner composition causes no impaction to a carrier and no adhesion of the toner particles to a photoreceptor, and can form stable, sufficient images for a long time.

3 Claims, No Drawings

ELECTROPHOTOGRAPHIC TONER COMPOSITION

FIELD OF THE INVENTION

The present invention relates to an electrophotographic toner composition, and particularly to an electrophotographic toner composition in which small-sized toner particles are used for achieving high image quality.

BACKGROUND OF THE INVENTION

Previously, various investigations into adhesion of toner particles to photoreceptors (so-called filming) have been conducted. For example, the method of adding a metallic soap to a developer layer to prevent toner particles from adhering and the method of adding an abrasive to a developer layer to scrape off adhered toner particles.

At present, progressive investigations are made of not only inorganic photoreceptors, but also organic photoreceptors, and the share of organic photoreceptors are increasingly broaden. The techniques of copying machines and printers have also progressed so as to use small-sized toner particles to attain high image quality.

As these techniques progress, a new problem is encountered in the techniques for preventing toner particles from adhering to photoreceptors.

Namely, although tolerable effects were realized by the use of the inorganic photoreceptors described above and the toner particles having a normal particle size in the conventional techniques, the use of the organic photoreceptors and the small-sized toner particles makes it impossible to obtain sufficient effects.

One reason for this is that the organic photoreceptors are soft in their surface compared to the inorganic photoreceptors and high in their reactivity, which is liable to cause the life thereof to be reduced.

When such organic photoreceptors are used, therefore, the use of so-called cleaning assistants such as metallic soaps, waxes and abrasives results in deterioration and scraping of the photoreceptors.

On the other hand, when the size of the toner particles is reduced, the problem arises that impaction to a carrier is liable to occur and the life is reduced. Furthermore, the small-sized toner particles are inferior to the toner particles having a normal particle size (10 to 20 μm) in powder fluidity, and therefore, a large amount of fine inorganic particles are required to be used. In some cases, these fine inorganic particles contribute to filming.

For this reason, when the organic photoreceptor and the small-sized toner particles are used, there is no technique at present by which sufficient images can be obtained for a long period of time and which can prevent the toner particles from adhering to the photoreceptor to a satisfiable degree.

SUMMARY OF THE INVENTION

It is therefore an object of the present invention to provide an electrophotographic toner composition which induces no impaction to a carrier in a developer, causes no adhesion of toner particles to a photoreceptor and can form stable, satisfactory images for a long period of time, even when an organic photoreceptor and small-sized toner particles are used.

As a result of intensive studies, the present inventors discovered that the above-described object can be accomplished by using a fine metal oxide powder as an additive, and surface treating the powder with a specified silane coupling agent as an agent for imparting hydrophobic property, thus completing the present invention.

The present invention provides an electro- photographic toner composition comprising (A) toner particles with an average particle diameter of 9 μm or less comprising at least a binder resin and a colorant, and (B) an additive, wherein said additive is a fine metal oxide powder surface coated with at least one agent for imparting hydrophobic property selected from the group consisting of the following formulae (1), (2) and (3):

$$R_1Si(X)_3 \quad (1)$$

$$R_1R_2Si(X)_2 \quad (2)$$

$$R_1R_2R_3Si(X)_1 \quad (3)$$

wherein $R_1$ represents a substituted or unsubstituted alkyl group having a molecular weight of 113 or more, $R_2$ and $R_3$ each represents hydrogen, an alkyl group or an allyl group, and X represents chlorine, an alkoxy group or an acetoxy group.

DETAILED DESCRIPTION OF THE INVENTION

The present invention will hereinafter be illustrated in detail.

The fine metal oxide powders which can be used in the present invention include known powders such as titanium oxide, silicon oxide, zirconium oxide, aluminum oxide and fine ceramics. As the fine powders, fine particles having a BET surface area of 50 $m^2/g$ or more are preferably used. In particular, amorphous titania sufficient in stability against environmental changes, particularly showing less change in charge quantity against changes of temperature and humidity, is preferred.

These additives are surface treated to be rendered hydrophobic with coupling agents, utilizing gas phase or liquid phase reaction, whereby the toner particles are prevented from adhering to the organic photoreceptors, and impaction to a carrier can be prevented which takes place in using the toner particles having an average particle diameter of 9 μm or less and a large amount of additive.

The agents for imparting hydrophobic property used in the present invention are silane coupling agents represented by the above-described formulae (1), (2) and (3). Specifically, the following compounds are used.

$C_8H_{17}Si(OCH_3)_3$, $C_{10}H_{21}Si(OCH_3)_3$
$C_{10}H_{21}SiCl_8$, $CH_3(CH_2)_{11}SiSiCl_3$

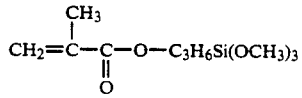

$CH_3(CH_2)_{11}Si(OC_2H_5)_3$

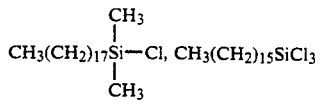

$CH_3(CH_2)_{15}Si(OC_2H_5)_3$

-continued

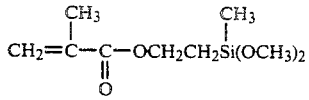

$C_8H_{17}(CH_2)_3Si(OC_2H_5)_3$

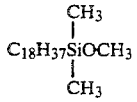

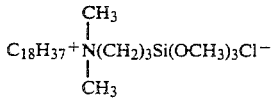

$CH_3(CH_2)_{17}SiCl_3$, $CH_3(CH_2)_{17}Si(OCH_3)_3$

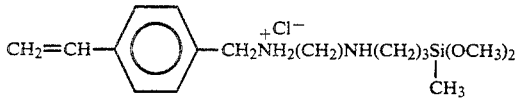

As described above, in the silane coupling agents used in the present invention, $R_1$ is a substituted or unsubstituted alkyl group having a molecular weight of 113 or more. When particles having a BET surface area of 50 $m^2/g$ or more are used as the additive, treatment of the additive particles with an agent for imparting hydrophobic property in which $R_1$ has a molecular weight of less than 113 causes significant impaction of the toner particles to the carrier, resulting in a reduction in the life of a developer, and further causes increased adhesion of the toner particles to the photoreceptor, resulting in deterioration in image quality and generation of defects in image quality.

In contrast, the use of an agent for imparting hydrophobic property in which $R_1$ has a molecular weight of 113 or more can prevent the impaction, whereby the life of the developer can be prolonged, and further can prevent the toner particles from adhering to the photoreceptor. In particular, an agent for imparting hydrophobic property in which $R_1$ has a molecular weight of 140 or more is excellent in its effect.

Furthermore, $R_1$ is preferably a long-chain alkyl group having 8 or more carbon atoms. The toner to which a fine powder having the long-chain alkyl group has been added can decrease friction with the carrier, so that the impaction of the toner particles can be prevented more effectively. The long-chain alkyl group preferably has 8 to 20 carbon atoms.

In the above formulae (2) and (3), the alkyl group represented by $R_2$ or $R_3$ preferably is a methyl group or an ethyl group.

In the above formulae (1), (2) and (3), when X is an alkoxy group, a methoxy group and an ethoxy group are preferably used in view of their high reactivity. Further, the substituent groups for the substituted alkyl group of $R_1$ include an amino group, a vinyl group, a phenyl group, a hydroxyl group, a carbonyl group, etc.

In the toner composition of the present invention, it is preferred that the additive content is from 0.1 to 5 parts by weight per 100 parts by wight of toner.

In the present invention, known toner particles comprising at least a colorant and a binder resin are used as the toner particles to which the above-described fine metal oxide powder is added.

Examples of the binder resins include homopolymers or copolymers of styrene compounds such as styrene and chlorostyrene; monoolefins such as ethylene, propylene, butylene and isoprene; vinyl esters such as vinyl acetate, vinyl propionate, vinyl benzoate and vinyl butyrate; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ethers such as vinyl methyl ether, vinyl ethyl ether and vinyl butyl ether; and vinyl ketones such as vinyl methyl ketone, vinyl hexyl ketone and vinyl isopropenyl ketone. Particularly typical binder resins are polystyrene, styrene-alkyl acrylate copolymers, styrene-alkyl methacrylate copolymers, styrene-acrylonitrile copolymers, styrene-butadiene copolymers, styrene-maleic anhydride copolymers, polyethylene and polypropylene. In addition, polyesters, polyurethanes, epoxy resins, silicone resins, polyamides, modified rosin, paraffins and waxes can also be used.

Typical examples of the colorants for the toner particles include carbon black, Nigrosine, Aniline blue, Calco Oil Blue, Chrome Yellow, Ultramarine Blue, Du Pont Oil Red, Quinoline Yellow, Methylene Blue chloride, Phthalocyanine Blue, Malachite green oxalate, Lampblack, Rose Bengal, C.I. Pigment Red 48:1, C.I. Pigment Red 122, C.I. Pigment Red 57:1, C.I. Pigment Yellow 97, C.I. Pigment Yellow 12, C.I. Pigment Blue 15:1 and C.I.Pigment Blue 15:3. The toner particles may further contain known additives such as charge control agents and fixing assistants, if desired.

In the toner particle, it is preferred that the colorant content is from 1 to 10 parts by weight per 100 parts by weight of the binder resin.

The toner particles usually have an average particle diameter of 9 μm or less and preferably 4 to 8 μm.

The electrophotographic toner composition of the present invention may be either a one-component toner developer using no carrier or a two-component developer using a carrier. It is however preferred that the composition is used as the two-component developer.

When the carriers are used, there is no particular restriction as long as they are known carriers. The carriers which can be used include iron powder carriers, ferrite carriers, surface-coated ferrite carriers and magnetic powder dispersion type carriers.

In the electrophotographic toner composition of the present invention, adhesion of the above-described additives to the surface of the toner particles can be carried out by the use of know means such as a high-speed mixer, specifically a Henschel mixer or a V-type blender.

The present invention will hereinafter be illustrated in detail with reference to Examples.

EXAMPLE 1

A. Preparation of Toner

Ninety-six parts by weight of a polyester resin having a Tg of 60° C. and a softening point of 110° C. and 4 parts by weight of Carmine 6BC4 as a colorant were melt-kneaded, pulverized and classified to obtain toner particles having a volume average particle diameter of 7 μm (determined by the Coulter counter method).

B. Treatment for Rendering Additives Hydrophobic

Metal oxides, #130 (silica having a BET surface area of 130 $m^2/g$, produced by Nippon Aerosil) and amorphous titania UFP (having a BET surface area of 100

$m^2/g$, produced by Idemitsu Kosan), were treated with the following silane coupling agents by the following method.

$CH_3Si(OCH_3)_3$, $C_4H_9Si(OCH_3)_3$ $C_8H_{17}Si(OCH_3)_3$, $C_{10}H_{21}Si(OCH_3)_3$

Ten grams of the above-described amorphous titania was dispersed in 100 ml of methanol, and 10 g of the above-described silane coupling agent was added dropwise thereto, followed by stirring with a magnet stirrer for 30 minutes. Then, the titania treated with the silane coupling agent was filtered, and dried at 120° C. for 2 hours. The resulting product was ground by a pin mill (produced by Itoman Engineering) to obtain an additive.

C. Mixing of Additive and Toner

Forty grams of the toner obtained in A and 1 g of each of the additives were mixed with each other by a sample mill (produced by Kyowa Riko) to obtain a toner for addition. The resulting toner was passed through a 45-μm sieve.

D. Evaluation of Adhesion to Photoreceptor

The toner for addition obtained in C and carrier particles obtained by coating ferrite core particles having an average particle diameter of 50 μm with a blend of a perfluoroalkyl acrylate polymer and an acrylic polymer were placed at a toner concentration of 8% in a modified two-component developer of a printer (4105 machine, produced by Fuji Xerox Corporation) using an organic photoreceptor, and the print test was repeated 30,000 times. Adhesion of the toner particles to the photoreceptor was perceived as white spots on an entire solid image. Results thereof are shown in Table 1. As the uniformity of a halftone, the difference in image density between the halftone image at the initial stage and one after 30,000 prints was visually evaluated.

TABLE 1

| Treating Agent | Molecular Weight of $R_1$ | Degree* of White Spots | Halftone Uniformity** |
|---|---|---|---|
| #130*** | | | |
| $CH_3Si(OCH_3)_3$ | 15 | Many | C |
| $C_4H_9Si(OCH_3)_3$ | 57 | Few | B |
| $C_8H_{17}Si(OCH_3)_3$ | 113 | None | A |
| $C_{10}H_{21}Si(OCH_3)_3$ | 141 | None | A |
| UFP**** | | | |
| $CH_3Si(OCH_3)_3$ | 15 | Many | C |
| $C_4H_9Si(OCH_3)_3$ | 57 | Few | B |
| $C_8H_{17}Si(OCH_3)_3$ | 113 | None | A |
| $C_{10}H_{21}Si(OCH_3)_3$ | 141 | None | A |

*Many: 10 spots/$cm^2$ or more
Few: 2 to 9 spots/$cm^2$
None: 1 spot/$cm^2$ or less
**Visual evaluation after 30,000 prints.
A: Good
B: Occurrence of unbalance of copy density
C: Presence of white spots in images
***Silicon oxide produced by Nippon Aerosil
****Amorphous titania produced by Idemitsu Kosan As shown in Table 1, the use of the additives of the present invention provides good images and does not produce troubles due to adhesion of the toner particles to the photoreceptor.

COMPARATIVE EXAMPLE 1

To 40 g of toner particles having an average particle diameter of 10 μm, 0.7 g of each of all the additives used in Example 1 was added (so that the toner surface coverage becomes equal to that of Example 1), and a toner was prepared by the method of C of Example 1. Then, the evaluation was conducted in the same manner as with Example 1. As a result, no troubles due to adhesion of the toner particles to the photoreceptor took place for all the additives. However, unbalance of copy density is generated and the halftone uniformity was inferior.

As apparent from the above comparison of Example and Comparative Example, according to the present invention, the treatment of amorphous titania with a coupling agent having a long-chain alkyl group reduces the friction of fine powder particles with a photoreceptor and makes adhesion of toner particles to the photoreceptor difficult, whereby white spots produced by adhesion of the toner particles to the photoreceptor can be prevented. In addition, the impaction to a carrier can be prevented, and the difference in image density between the halftone image at the initial stage and one after 30,000 prints is decreased.

While the invention has been described in detail and with reference to specific embodiments thereof, it will be apparent to one skilled in the art that various changes and modifications can be made therein without departing from the spirit and scope thereof.

What is claimed is:

1. An electrophotographic toner composition comprising (A) toner particles with an average particle diameter of 9 μm or less comprising at least a binder resin and a colorant, and (B) an additive, wherein said additive is a fine metal oxide powder surface coated with at least one agent for imparting hydrophobic property selected from the group consisting of the following formulae (1), (2) and (3):

$$R_1Si(X)_3 \quad (1)$$

$$R_1R_2Si(X)_2 \quad (2)$$

$$R_1R_2R_3Si(X)_1 \quad (3)$$

wherein $R_1$ represents a substituted or unsubstituted alkyl group having a molecular weight of 113 or more, $R_2$ and $R_3$ each represents hydrogen, an alkyl group or an allyl group, and X represents chlorine, an alkoxy group or an acetoxy group.

2. An electrophotographic toner composition as in claim 1, wherein $R_1$ has a molecular weight or 140 or more.

3. An electrophotographic toner composition as in claim 1, wherein said toner particles have an average particle diameter of from 4 to 8 μm.

* * * * *